US006380962B1

(12) United States Patent
Miyazaki

(10) Patent No.: US 6,380,962 B1
(45) Date of Patent: Apr. 30, 2002

(54) RAY APPLYING DEVICE

(75) Inventor: Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/468,079

(22) Filed: Dec. 21, 1999

(30) Foreign Application Priority Data

Dec. 21, 1998 (JP) ..... 10-362968

(51) Int. Cl.[7] ..... B41J 2/32
(52) U.S. Cl. ..... 347/171
(58) Field of Search ..... 347/171, 175; B41J 3/20

(56) References Cited

U.S. PATENT DOCUMENTS 5,986,682 A * 11/1999 Itou ..... 347/171

FOREIGN PATENT DOCUMENTS

JP 361294880 A * 12/1986 ..... B41J/3/20

* cited by examiner

*Primary Examiner*—N. Le
*Assistant Examiner*—K. Feggins
(74) *Attorney, Agent, or Firm*—Sughrue Mion, PLLC

(57) ABSTRACT

A ray applying device as a fixer applies ultraviolet or near ultraviolet rays to a recording surface of a thermosensitive recording sheet. The recording surface is extended two-dimensionally in main and sub scan directions. A plasma display panel extends in the main scan direction, for emitting the ultraviolet or near ultraviolet rays.

23 Claims, 12 Drawing Sheets

RAY APPLYING DEVICE

BACKGROUND OF THE INVENTION

1. Field of the Invention

The present invention relates to a ray applying device. More particularly, the present invention relates to a ray applying device for applying such electromagnetic rays as visible light or ultraviolet rays to an object, typically used in a color thermal printer or an image reader apparatus.

2. Description Related to the Prior Art

A color thermal printer is used with a color thermosensitive recording material, which includes a support and three thermosensitive coloring layers of cyan, magenta and yellow colors formed thereon to be used for full-color printing. The yellow coloring layer is the farthest from the support, and has the highest heat sensitivity. The cyan coloring layer is the nearest to the support, and has the lowest heat sensitivity. The yellow and magenta coloring layers have fixability in response to application of ultraviolet rays of particular wavelengths. The thermal printer incorporates a thermal head and an illuminating device or ray applying device. While the recording material is conveyed in forward and backward directions, the thermal head presses the recording material and applies heat to the coloring layers for thermal recording. After application of the heat, the ray applying device including an ultraviolet lamp is driven to apply the ultraviolet rays to the recording material, for fixing an overlaid coloring layer each time before an underlaid coloring layer is colored.

Optical apparatuses such as a scanner, a telefacsimile machine and a copying machine incorporate the ray applying device for illuminating an original sheet and an image reader device for reading an image of the original sheet. In such an apparatus, the original sheet is conveyed in a manner relative, to the ray applying device and the image reader device, and illuminated by the ray applying device in the conveyance. The light reflected by the surface of the original sheet is focused on an image sensor, which reads an image of the original sheet by one line according to photoelectric conversion pixel by pixel. An example of the ray applying device is a fluorescent lamp, which is the ultraviolet lamp of a tubular shape and disposed perpendicularly to the direction of the relative conveyance of the original sheet or the image reader device.

A good example of the light source used in the ray applying device in each apparatus is the ultraviolet lamp in the tubular shape. The ultraviolet lamp has a circular shape as viewed in cross section, and emits the ultraviolet rays or visible rays in any radial directions at an equal intensity. In order to change the paths of the ultraviolet rays or visible rays emitted in directions different from the original sheet or the recording material, a reflector is disposed behind the ultraviolet lamp for efficiently reflecting this part of the ultraviolet rays or visible rays.

In the ray applying device having the ultraviolet lamp and the reflector, however, a sufficient space is required between the ultraviolet lamp and the reflector for the purpose of reflecting the light effectively toward the object by the reflector. The space causes the ray applying device to have a considerable size, and inconsistent to reduce the size of the apparatus incorporating the ray applying device. In the thermal printer in particular, an increase in the conveyed distance of he recording material lowers the speed of printing, and increases an area of margins. Also, the sufficient distance between the fixer and the recording material causes a problem in shortage in the fixation.

Another problem lies in that the ray emission intensity of the ultraviolet lamp in the tubular shape is different between its portions. In general, end portions of the ultraviolet lamp emit rays at lower intensity than its middle portion. The ultraviolet rays in the thermal printer cannot be applied uniformly to the recording material, so that unevenness occurs in fixation. Also a problem arises in a scanner, a telefacsimile machine or a copying machine in that unevenness occurs in brightness in the image read by the image reader device.

SUMMARY OF THE INVENTION

In view of the foregoing problems, an object of the present invention is to provide a ray applying device for applying electromagnetic rays to an object at an irradiance kept uniform on its object surface.

In order to achieve the above and other objects and advantages of this invention, a ray applying device applies electromagnetic rays to an object surface of a target object, the object surface extending two-dimensionally in main and sub scan directions. A surface light source extends in the main scan direction, for emitting the electromagnetic rays.

Furthermore, a filter is disposed in front of the surface light source, for shifting a ray emission center wavelength of the surface light source.

The electromagnetic rays are visible or ultraviolet.

In a preferred embodiment, the surface light source comprises at least one light-emitting display panel.

The light-emitting display panel has a size larger than the target object in relation to the main scan direction.

In another preferred embodiment, there is a ray applying station for setting the target object so as to dispose the object surface at a predetermined distance from the light-emitting display panel. The light-emitting display panel includes a middle portion disposed substantially in a middle in the main scan direction. There are two end portions between which the middle portion is disposed, and in which emission intensity of the electromagnetic rays is preset higher than in the middle portion in consideration of the predetermined distance, so as to provide the object surface with irradiance equal to irradiance with which the electromagnetic rays from the middle portion provides the object surface.

The end portions have a greater size in the sub scan direction than the middle portion, for increasing the emission intensity.

In still another preferred embodiment, the light-emitting display panel includes a panel body. A fluorescent film is disposed on an inside of the panel body. The end portions have the fluorescent film at a greater thickness than the middle portion, for increasing the emission intensity.

The target object is thermosensitive recording material, and the electromagnetic rays optically fix the thermosensitive recording material.

In one aspect of the present invention, the at least one light-emitting display panel is an array of plural light-emitting display panels arranged in the main scan direction.

The middle portion and the end portions are a middle light-emitting display panel and end light-emitting display panels among the plural light-emitting display panels. Furthermore, a light source driver drives the plural light-emitting display panels, for providing the end light-emitting display panels with first energy, and for providing the middle light-emitting display panel with second energy, the first energy being higher than the second energy, for increasing the emission intensity at the end light-emitting display panels.

In another preferred embodiment, the middle portion and the end portions are a middle light-emitting display panel and end light-emitting display panels among the plural light-emitting display panels. The end light-emitting display panels have a greater size in the sub scan direction than the middle light-emitting display panel, for increasing the emission intensity.

In another aspect of the present invention, the at least one light-emitting display panel is a group of plural light-emitting display panels arranged in plural lines extending in the main scan direction and in plural columns extending in the sub scan direction.

In still another preferred embodiment, the plural light-emitting display panels are arranged in a matrix manner. Furthermore, a light source driver drives selected ones of the plural light-emitting display panels. The selected light-emitting display panels includes at least one, P middle light-emitting display panel, disposed in a middle column among the plural columns, for constituting the middle portion, P being smaller than a number of the plural lines. Q end light-emitting display panels are arranged in two end columns among the plural columns, for constituting the end portions, Q being greater than P, for increasing the emission intensity.

In another preferred embodiment, the middle portion and the end portions are a middle column and end columns among the plural columns. A number of the plural lines is greater in the end columns than in the middle column, for increasing the emission intensity.

In still another aspect of the present invention, a thermal printer is provided, which is usable with thermosensitive recording material extended two-dimensionally in main and sub scan directions. The thermal printer includes a thermal head, extending in the main scan direction, for image recording to the recording material. A surface light source extends in the main scan direction, for image fixation to the recording material by applying electromagnetic rays thereto. A conveyor relatively moves the recording material in the sub scan direction relative to the thermal head and the surface light source.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
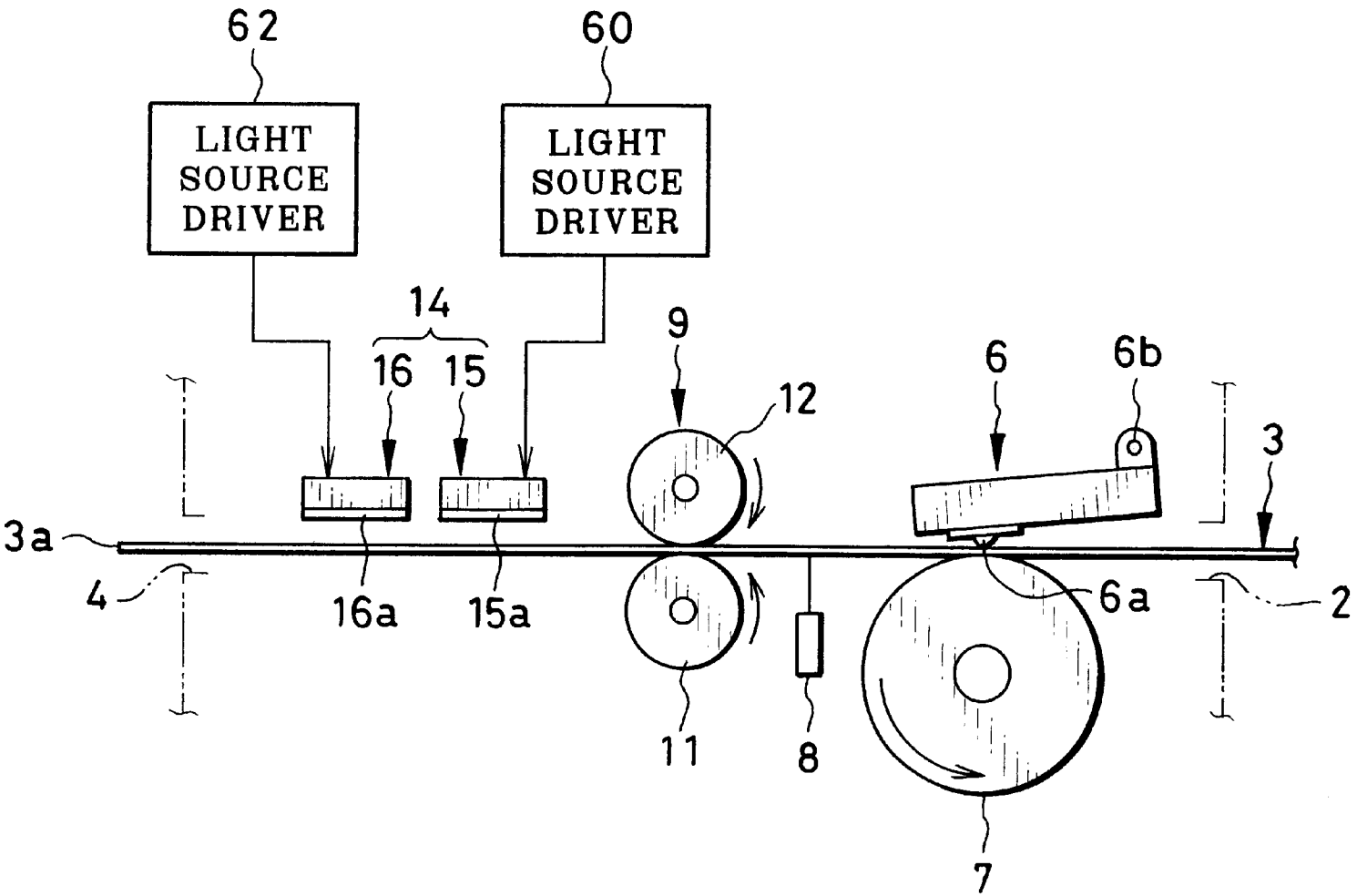
FIG. 1 is an explanatory view illustrating a color thermal printer.

In FIG. 1, a color thermal printer incorporating a ray applying device is depicted. The printer is provided with an insertion slot 2, through which color thermosensitive recording material 3 or recording sheet as target object is inserted and supplied. The recording material 3 is conveyed in forward and backward directions while a full-color image is thermally recorded and fixed. An exit slot 4 is also formed in the printer. After the thermal recording, the recording material 3 is exited through the exit slot 4. To reduce the size of the printer, a distance between the insertion slot 2 and the exit slot 4 is determined smaller than a size of the recording material 3 in the direction of the insertion. At least one portion of the recording material 3 is inevitably protruded from the insertion slot 2 or the exit slot 4 in the course of the forward and backward movement of the recording material 3.

A thermal head 6 and a platen roller 7 are disposed in a position interior from the insertion slot 2. A reflection type of photo sensor 8 and conveyor rollers 9 are disposed interior from the thermal head 6. The photo sensor 8 detects a leading edge 3*a* of the recording material 3.

An array 6*a* of a great number of heating elements is disposed in the thermal head 6. The heating element array 6*a* is in a direction of a main scan direction which is perpendicular to a sub scan direction in which the recording material 3 is conveyed. The thermal head 6 is pivotally movable about a pivot 6*b* between a recording position and a retracted position. The thermal head 6, when in the recording position, presses the recording material 3, and when in the retracted position, comes away from the recording material 3. As is not illustrated in the drawing, a head moving mechanism causes the thermal head 6 to move between the two positions, and include such parts as a solenoid and a cam mechanism. The heating element array 6*a* generates heat energy of which a value is adapted to each thermosensitive coloring layer to be colored. The platen roller 7 is caused to rotate by movement of the recording material 3.

The recording material 3 includes a support and three thermosensitive coloring layers of cyan, magenta and yellow colors formed thereon. The yellow coloring layer is the farthest from the support, and has the highest heat sensitivity, or is colored in yellow in response to low heat energy. The cyan coloring layer is the nearest to the support, and has the lowest heat sensitivity, or is colored in cyan in response to high heat energy. The yellow coloring layer is fixed by destruction of its coloring ability upon application of near ultraviolet rays of a wavelength of 420 nm. The magenta coloring layer has heat sensitivity between those of the yellow and cyan coloring layers, and is fixed by destruction of its coloring ability upon application of ultraviolet rays of a wavelength of 365 nm. It is to be noted that a black coloring layer may be added into the recording material 3 as a fourth coloring layer. Also, it is possible to use the recording material 3 in which the order of the coloring layers is differently determined.

The conveyor rollers 9 include a capstan roller 11 and a pinch roller 12. The capstan roller 11 is rotated by a motor in forward and backward directions. The pinch roller 12 is pressed toward the capstan roller 11, and is caused to rotate by rotation of the capstan roller 11. The conveyor rollers 9 nip the recording material 3 inserted in the insertion slot 2, and convey the same in the forward and backward directions.

A fixer 14 or ray applying device is disposed downstream from the conveyor rollers 9 in the forward direction. The fixer 14 is constituted by a yellow-fixing light-emitting display panel 15 and a magenta-fixing light-emitting display panel 16 both as surface light sources. There are filters 15*a* and 16*a* secured to respectively front surfaces of the yellow-fixing and magenta-fixing display panels 15 and 16 for modulating emitted ultraviolet rays at emission center wavelengths of 420 and 365 nm. An example of the yellow-fixing and magenta-fixing display panels 15 and 16 is a plasma display panel. The fixer 14, being constructed in such a manner, can have a considerably reduced size in comparison with the prior structure including an ultraviolet lamp of a tubular shape. The printer can have a small size and can operate at a high printing speed.

Note that, instead of using the filters 15*a* and 16*a* for shifting the light-emitting center wavelengths to 420 nm and 365 nm, it is possible to use fluorescent film with specialized fluorescent material in the yellow-fixing and magenta-fixing display panels 15 and 16 so as to shift the light-emitting center wavelengths without the use of the filters 15*a* and 16*a*.

Figure 2:
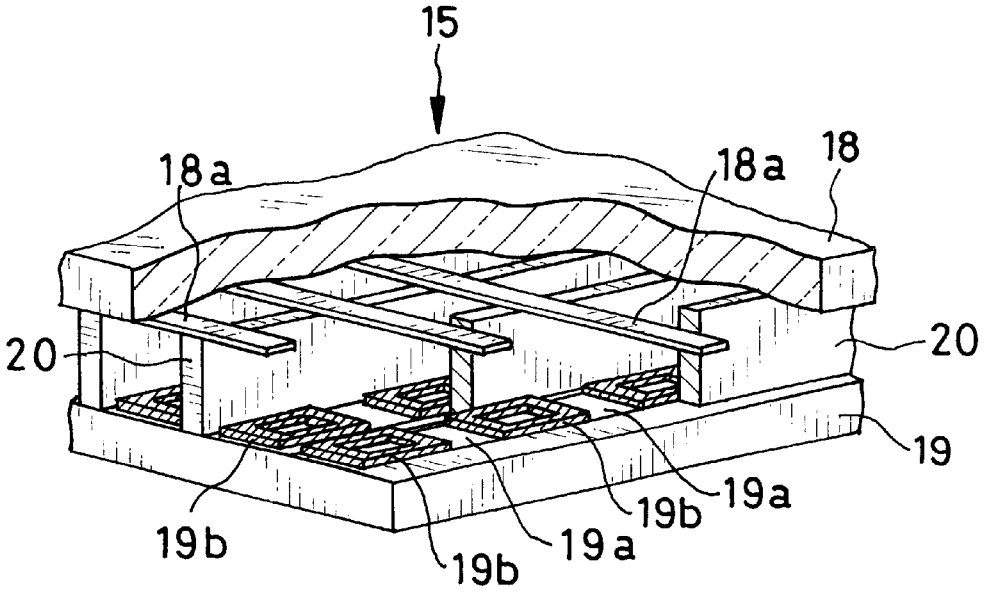
FIG. 2 is a perspective, partially broken, illustrating a structure of a plasma display panel in a fixer.
Figure 3:
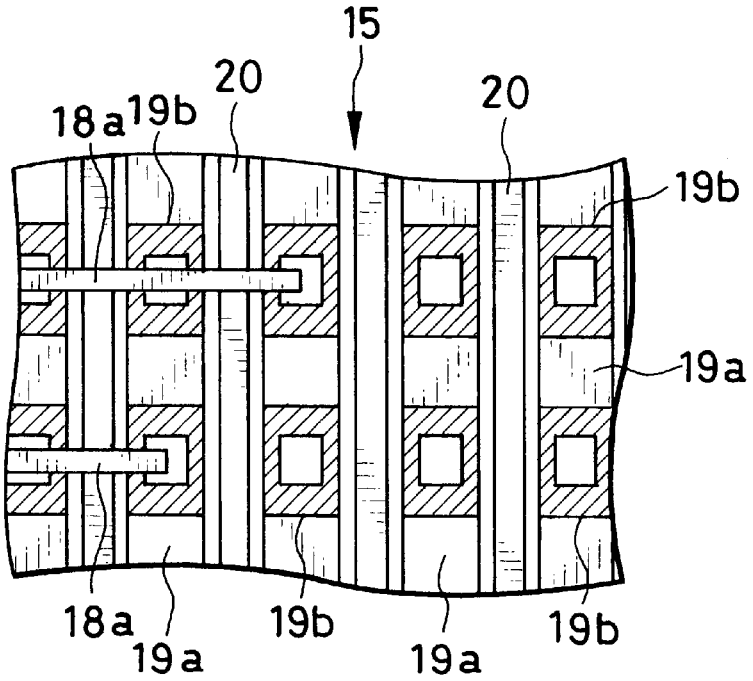
FIG. 3 is an explanatory view in plan, illustrating the plasma display panel.

In FIGS. 2 and 3, the yellow-fixing display panel 15 as a plasma display panel is illustrated. A front base plate 18 of glass and a rear base plate 19 of glass constitute a panel body or outer walls of the yellow-fixing display panel 15. The front base plate 18 is adapted to emission of ultraviolet rays. Negative poles 18*a* are disposed on a rear surface of the front base plate 18, and formed by thick-film printing with paste of nickel, aluminum or the like. Positive poles 19*a* are disposed on a front surface of the rear base plate 19, and formed by thick-film printing with paste of nickel, aluminum or the like. A fluorescent film 19*b* is formed on the positive poles 19*a* with fluorescent material by thick-film printing, and disposed in a pattern having holes for electrical discharge of the positive pole. There are barrier ribs 20, disposed between the positive poles 19*a* in a manner of splitting dots, having a thickness of 200 $\mu$m, and formed by thick-film printing for plural times sufficient for this great thickness.

In the front and rear base plates 18 and 19, the negative poles 18*a* are extended to intersect the positive poles 19*a* perpendicularly. The negative poles 18*a* are combined to overlap with the positive poles 19*a* which emerge through the holes in the fluorescent film 19*b*. Peripheral portions of the front and rear base plates 18 and 19 are tightly enclosed. Spaces defined between the barrier ribs 20 and between the negative poles 18*a* and the positive poles 19*a* are filled with mixed gas of helium (He) and xenon (Xe), or mixed gas of helium (He) and krypton (Kr). When voltage is applied to the positive poles 19*a*, there occur electric discharge at the intersection points between the positive poles 19*a* and the negative poles 18*a* to emit rays. In such light-emitting display panels as plasma display panel, intensity of emitted rays increases according to a thickness of the fluorescent film. It is to be noted that the magenta-fixing display panel 16 has the same structure as the yellow-fixing display panel 15.

Figures 4A, 4B, 4C:
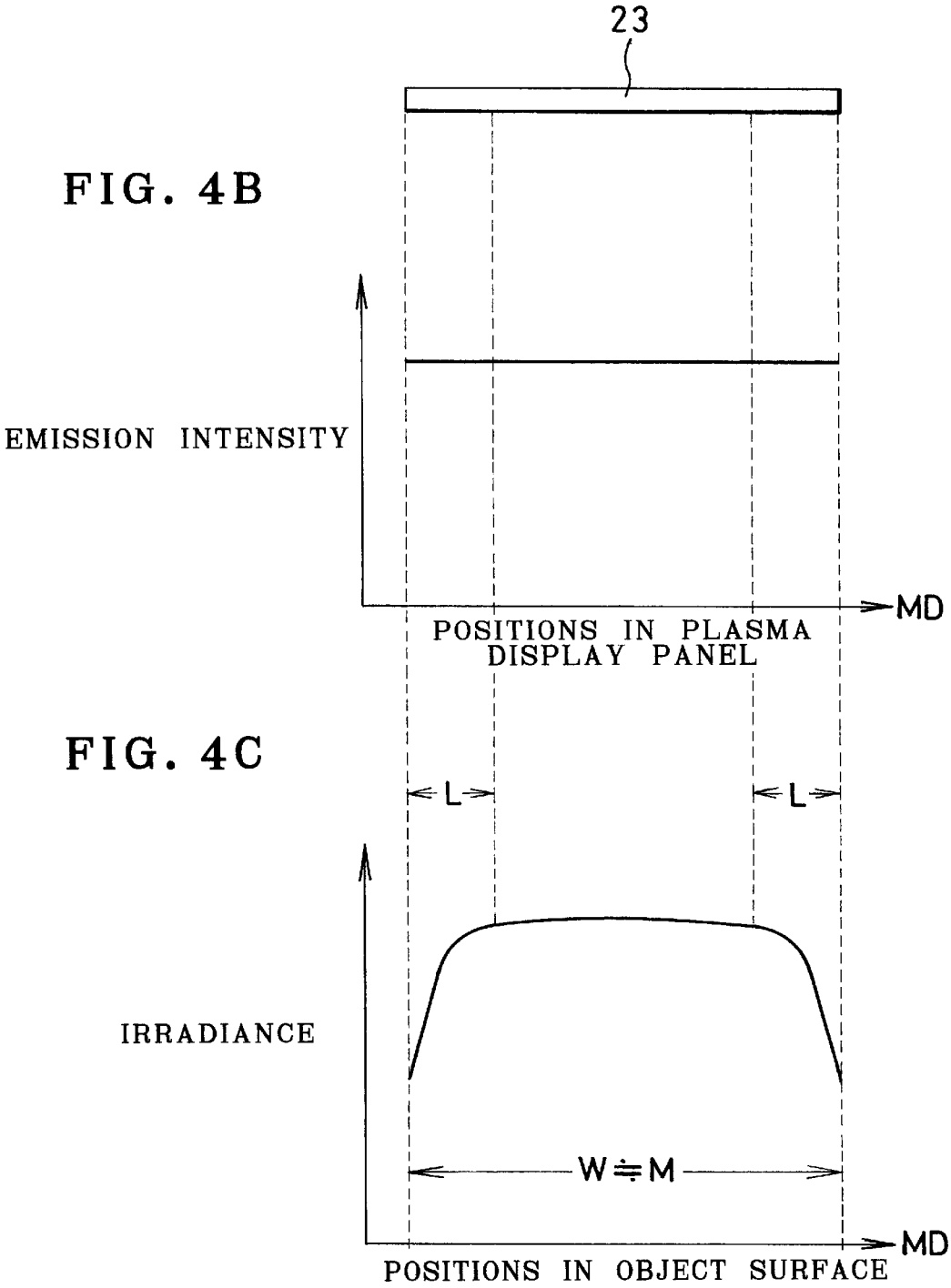
FIG. 4A is a bottom plan illustrating the plasma display panel.
FIG. 4B is a graph illustrating a relationship between a position in the plasma display panel and its emission intensity.
FIG. 4C is a graph illustrating a relationship between a position in an object surface and its irradiance.

FIG. 4A illustrates a plasma display panel 23, which is the same as the yellow-fixing and magenta-fixing display panels 15 and 16. In FIG. 4B, intensity of ray emission from each portion of the plasma display panel 23 is illustrated. In the plasma display panel 23, the ray emission intensity at the middle position is equal to the ray emission intensity at the end positions. But when ultraviolet rays are applied to the recording material 3 by the plasma display panel 23, the irradiance on a recording surface of the recording material 3 is nearly ½ as high at the middle position as at the end positions. See FIG. 4C. This is because the ray emitting area of the plasma display panel 23 opposed to the recording material 3 is ½ as large at the end positions as at the middle position. The irradiance is lower at the end positions, which, in the thermal printer, causes unevenness or shortage in fixation.

Figure 5A:
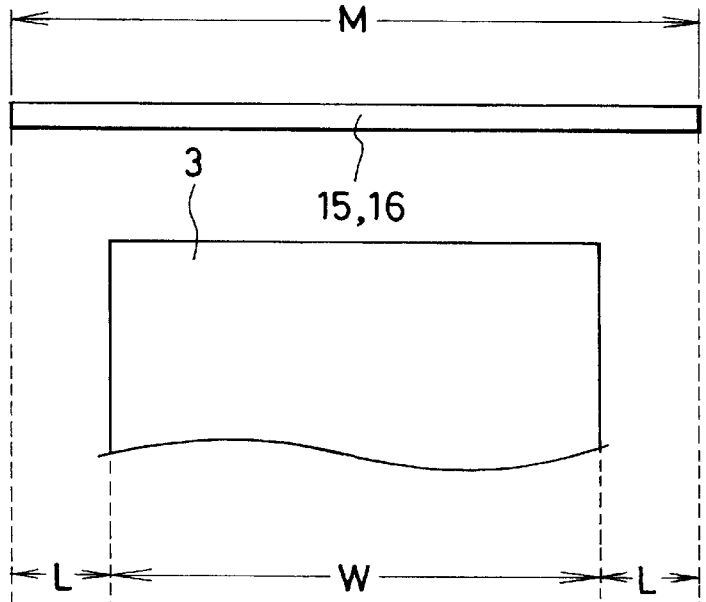
FIG. 5A is a bottom plan illustrating a light-emitting display panel having a sufficiently great size M.
Figure 5B:
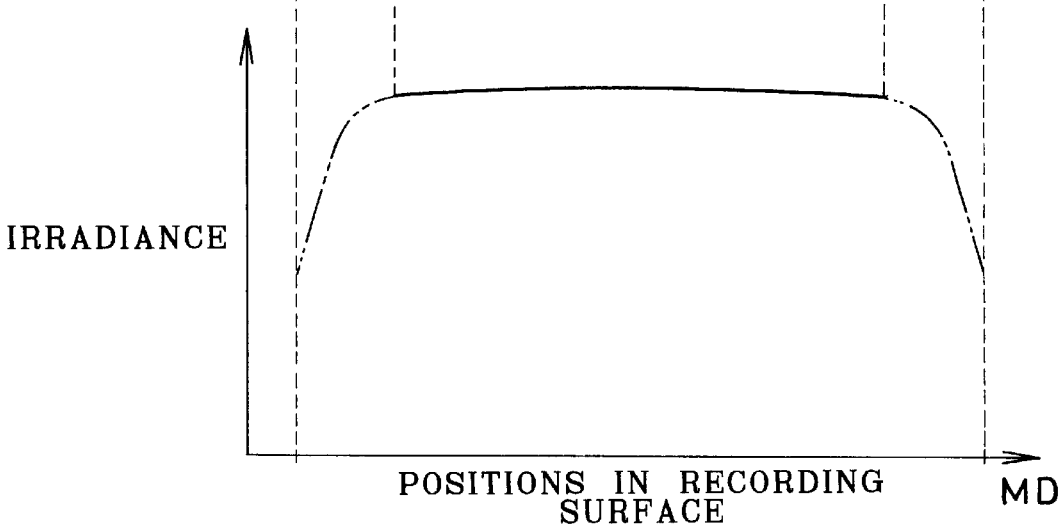
FIG. 5B is a graph illustrating a relationship between a position in the recording surface and its irradiance.

To prevent such problems, a size M of the yellow-fixing and magenta-fixing display panels 15 and 16 is determined as illustrated in FIG. 5A. The size M is greater than a size W of the recording material 3 by an amount 2L, which is a range of occurrence of drop in irradiance. End portions of the yellow-fixing and magenta-fixing display panels 15 and 16 are prevented from being opposed to the recording material 3. In FIG. 5B, irradiance of ultraviolet rays applied by the yellow-fixing and magenta-fixing display panels 15 and 16 to the recording material 3 is uniform in the whole region in the main scan direction MD. Each coloring layer of the recording material 3 can be fixed without occurrence of unevenness and shortage in the fixation.

The operation of the present embodiment is described now. In FIG. 1, the color thermal printer is connected with a personal computer. If a user desires to print a frame in the course of using the personal computer, he or she operates a keyboard or the like to input a command signal for starting printing. The personal computer sends printing data to the color thermal printer. The thermal printer stores the printing data in an internal memory in a temporary manner.

When a start signal for printing is input, a monitor display panel of a personal computer indicates messages of readiness for printing and insertion of the recording material 3 into the insertion slot 2 of the printer.

The user inserts the recording material 3 into the insertion slot 2 by following the messages. The thermal head 6, when not used, is in the retracted position away from the platen roller 7. The recording material 3 from the insertion slot 2 is passed between the thermal head 6 and the platen roller 7, until the leading edge 3a domes in contact with the conveyor rollers 9. The leading edge 3*a* of the recording material 3 is detected by the photo sensor 8.

When the photo sensor 8 detects the leading edge 3*a* of the recording material 3, the photo sensor 8 generates a detection signal, in response to which a motor for the conveyor rollers 9 starts being driven. The capstan roller 11 is caused to rotate in the counterclockwise direction. The pinch roller 12 is biased by the spring (not shown) downwards for contact with the capstan roller 11. The pinch roller 12 is caused to rotate in the clockwise direction by rotation of the capstan roller 11, and nips the leading edge 3*a* of the recording material 3.

At the same time as the recording material 3 is nipped by the conveyor rollers 9, the thermal head 6 is swung about the pivot 6*b* to the recording position, to press the heating element array 6*a* against the recording material 3 on the platen roller 7.

The recording material 3 is conveyed in a forward direction by the forward rotation of the conveyor rollers 9. The platen roller 7 is caused by the movement of the recording material 3 to rotate in the counterclockwise direction. While the recording material 3 is conveyed, a front edge of the recording region reaches the heating element array 6*a*. Each of the heating elements generates heat energy according to the pixel. A yellow image is recorded thermally to the yellow coloring layer by one line. After the yellow recording, the recording material 3 passes under the fixer 14, until the leading edge 3*a* comes to protrude from the exit slot 4.

When the yellow recording is finished, the thermal head 6 stops being driven, and moves to the retracted position. Immediately the yellow-fixing display panel 15 of the fixer 14 is turned on. The conveyor rollers 9 start rotating in the backward direction, to convey the recording material 3 toward the insertion slot 2 by advancing a rear edge of the recording material 3.

While the recording material 3 is conveyed in the backward direction, ultraviolet rays emitted by the yellow-fixing display panel 15 are modulated by the filter 15*a* to near ultraviolet rays peaking at the wavelength of 420 nm, and are applied to the recording material 3. The yellow-fixing display panel 15 fixes the yellow coloring layer to avoid coloring the yellow in the course of magenta recording. In FIG. 5A, the yellow-fixing display panel 15 is longer by 2L than the size W of the recording material 3 in the main scan direction MD. The area of portions of the yellow-fixing display panel 15 opposed to lateral edges of the recording material 3 in the main scan direction MD is equal to that of portions of the yellow-fixing display panel 15 opposed to the middle. Therefore, the irradiance of the ultraviolet rays applied to the recording material 3 is uniform to fix the yellow coloring layer without unevenness. See FIG. 5B.

When the front edge of the recording region of the recording material 3 is conveyed to the heating element array 6*a,* the conveyor rollers 9 stop. The yellow-fixing display panel 15 is turned off. Again the thermal head 6 moves to the recording position. The conveyor rollers 9 rotate in the forward direction to convey the recording material 3 in the forward direction. The thermal head 6 applies heat energy to the magenta coloring layer according to a magenta image, to record the magenta color.

When the magenta image is recorded to a rear end of the recording material 3 with reference to the forward direction of the recording material 3, the thermal head 6 moves again to the retracted position and becomes released from pushing the recording material 3. The conveyor rollers 9 are stopped. In the same manner as the yellow recording, the conveyor rollers 9 immediately start rotating in the reverse direction. At the same time the magenta-fixing display panel 16 of the fixer 14 is driven. Ultraviolet rays emitted by the magenta-fixing display panel 16 are modulated by the filter 16*a* to ultraviolet rays peaking at the wavelength of approximately 365 nm, and are applied to the recording material 3. The magenta-fixing display panel 16 fixes the magenta coloring layer to avoid coloring the magenta in the course of cyan recording. The magenta-fixing display panel 16 is longer by 2L than the size W of the recording material 3 in the main scan direction MD. The area of portions of the magenta-fixing display panel 16 opposed to lateral edges of the recording material 3 in the main scan direction MD is equal to that of portions of the magenta-fixing display panel 16 opposed to the middle. Therefore, the irradiance of the ultraviolet rays applied to the recording material 3 is uniform to fix the magenta coloring layer without unevenness.

When the front edge of the recording region of the recording material 3 comes to the position of the heating element array 6*a,* the thermal head 6 is shifted again to the recording position in the above-described manner. The conveyor rollers 9 rotate in the forward direction to convey the recording material 3 in the forward direction. The thermal head 6 during the conveyance records a cyan image to the cyan coloring layer.

Upon the finish of the thermal recording to all the coloring layers, the conveyor rollers 9 exit the recording material 3 through the exit slot 4. The cyan coloring layer is not provided with fixability, because the heat energy required for coloring the cyan coloring layer is so high that the cyan coloring layer is not colored in an ordinary preserved condition. But the yellow-fixing and magenta-fixing display panels 15 and 16 are kept turned on for the purpose of bleaching the rear edge portion of the recording material 3 having been nipped by the conveyor rollers 9 constantly in the course of thermal recording.

Consequently the use of the light-emitting display panels as surface light sources in the fixer 14 makes it possible to construct the fixer 14 and the printer in small sizes. It is also possible to increase a cumulative ray amount by enlarging the ray applying area, and to reduce diminishment of rays by shortening a distance between the recording material 3 and the fixer 14. Thus time required for fixation can be shortened to quicken the printing operation. Furthermore, the irradiance of the ultraviolet rays can be uniformly regularized on the surface of the recording material 3. A full-color print of a high quality can be produced without occurrence of shortage or unevenness in the fixation.

Figure 6A:
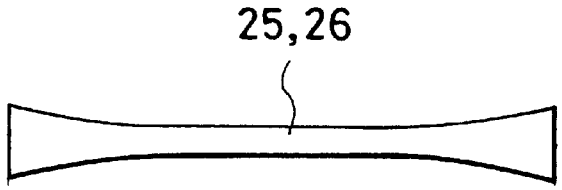
FIG. 6A is a bottom plan illustrating a light-emitting display panel in which end portions are wider.
Figure 6B:
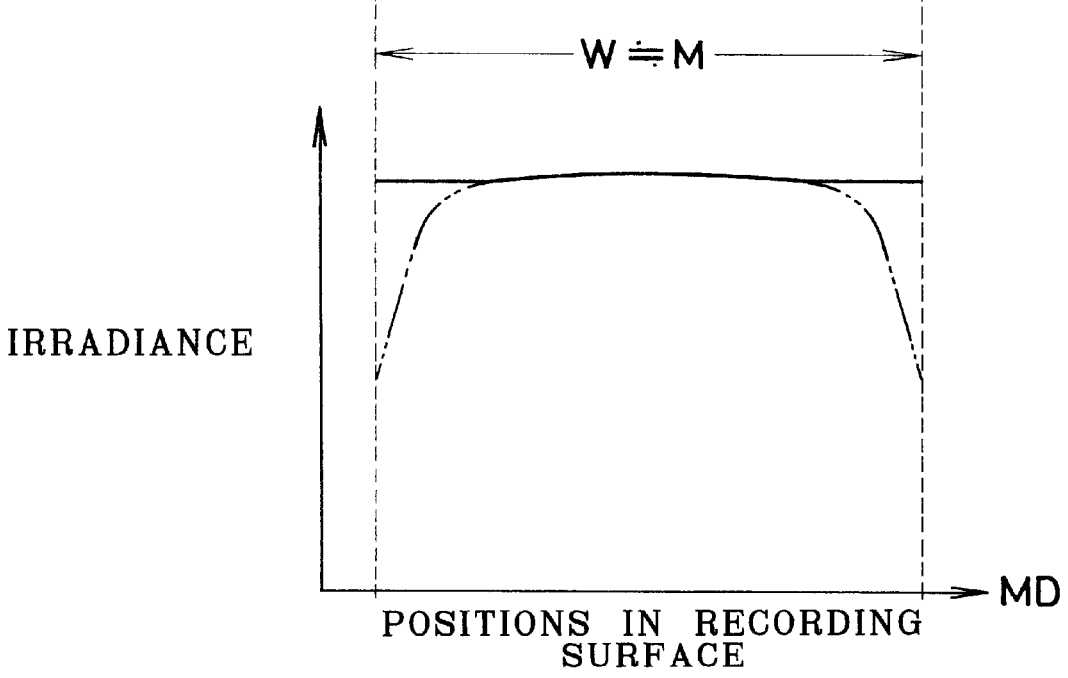
FIG. 6B is a graph illustrating a relationship similar to that of FIG. 5B but according to the structure of FIG. 6A.

In the above embodiment, the yellow-fixing and magenta-fixing display panels 15 and 16 have the size M greater than that of the recording material 3 in the main scan direction MD. Furthermore, another preferred embodiment of FIG. 6A makes it possible to apply ultraviolet rays at uniform irradiance to the recording material 3. A yellow-fixing light-emitting display panel 25 as surface light source has end portions and middle portions with reference to the main scan direction MD. The end portions have a greater size in the sub scan direction than the size of the middle portion. FIG. 6B depicts the state with the uniform irradiance on the recording material 3. This is because the cumulative irradiance of the ultraviolet rays, or the total amount of the applied ultraviolet rays, is greater at the lateral edge portions of the recording material 3 in the main scan direction MD. Also, a magenta-fixing light-emitting display panel 26 as surface light source has a similar shape.

Figures 7A, 7B, 7C:
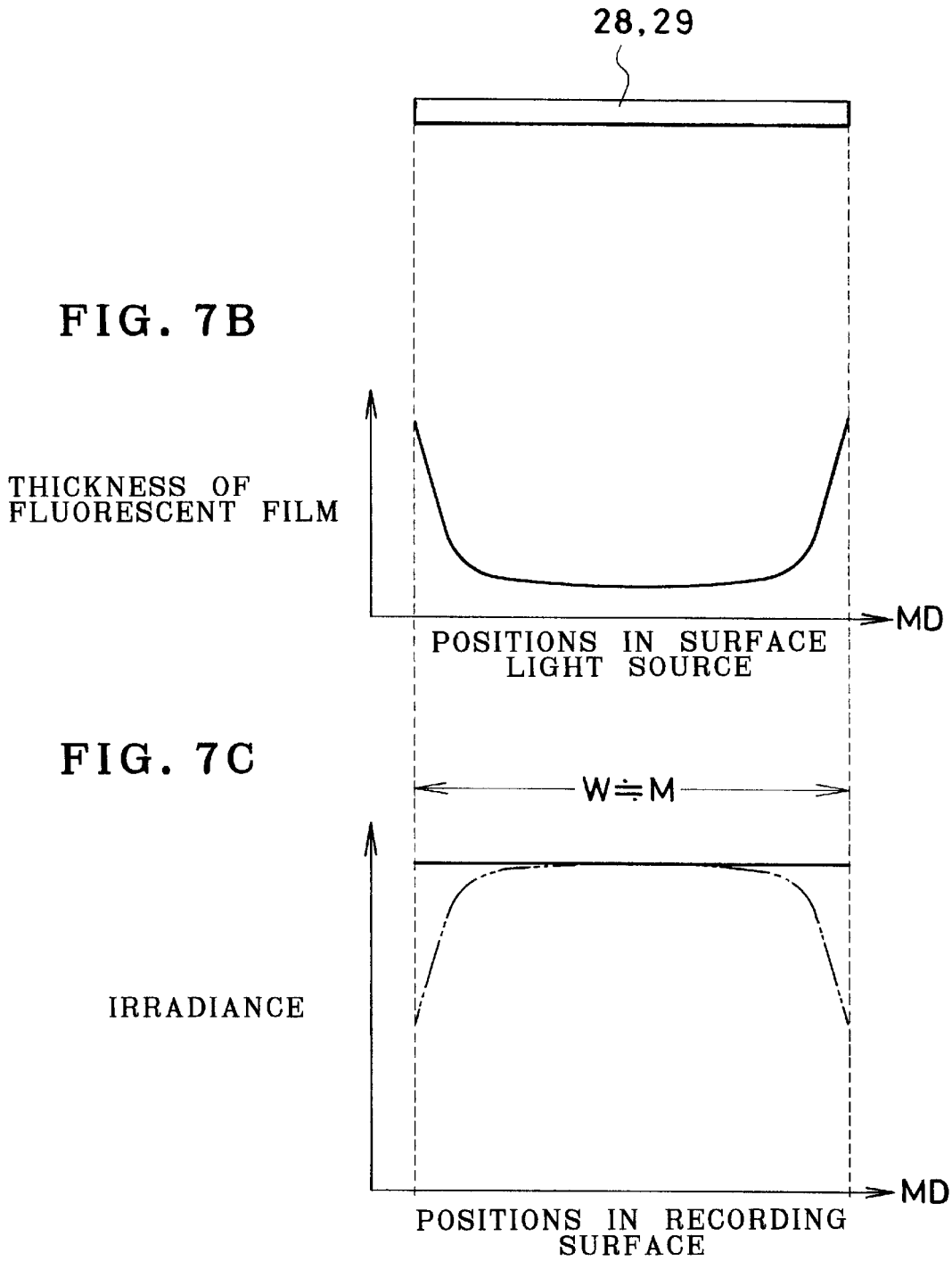
FIG. 7A is a bottom plan illustrating a light-emitting display panel in which a thickness of fluorescent film is changed.
FIG. 7B is a graph illustrating a relationship between a position in the light-emitting display panel and a thickness of fluorescent film.
FIG. 7C is a graph illustrating a relationship similar to that of FIG. 5B but according to the structure of FIG. 7A.

It is also possible to adjust the ray applying distribution by use of the characteristic of the plasma display panel. In FIG. 7A, still another preferred embodiment is depicted. A yellow-fixing light-emitting display panel 28 and a magenta-fixing light-emitting display panel 29 have a simply long shape. A coating or fluorescent film is formed on the inside of the yellow-fixing and magenta-fixing display panels 28 and 29 in a manner of FIG. 7B, or at a greater thickness in the end positions than in the middle position with respect to the main scan direction MD. Thus the yellow-fixing and magenta-fixing display panels 28 and 29 emit ultraviolet rays at a higher intensity in the end positions than in the middle position with respect to the main scan direction MD. The shortage in rays applied to the lateral edge portions of the recording material 3 in the main scan direction MD is compensated for. As illustrated in FIG. 7C, application of the ultraviolet rays can be uniformly regularized in the entirety of the recording material 3.

Figure 8A:
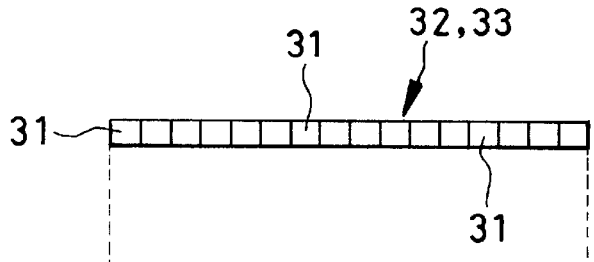
FIG. 8A is a bottom plan illustrating an array of light-emitting display panels.
Figure 8B:
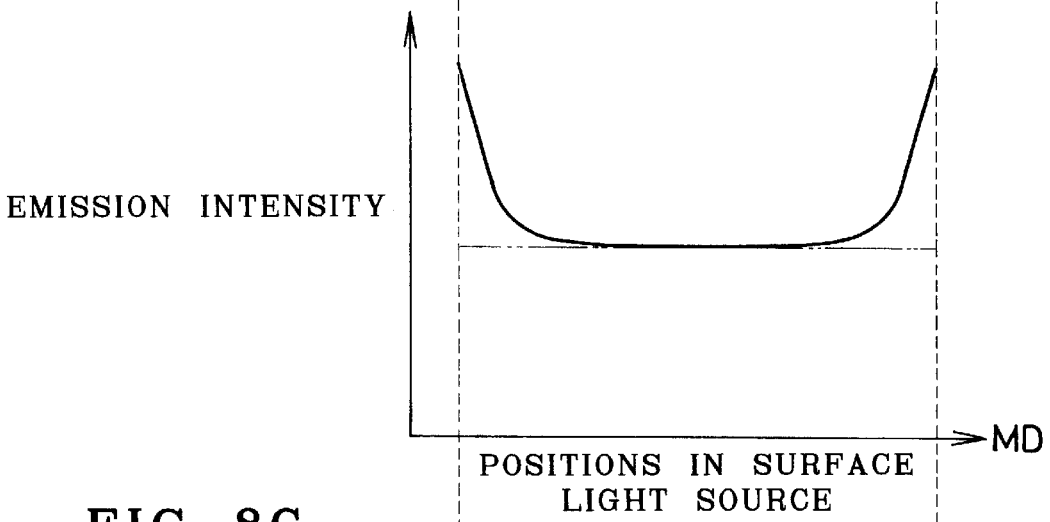
FIG. 8B is a graph illustrating a relationship between a position in the light-emitting display panel array and its emission intensity.
Figure 8C:
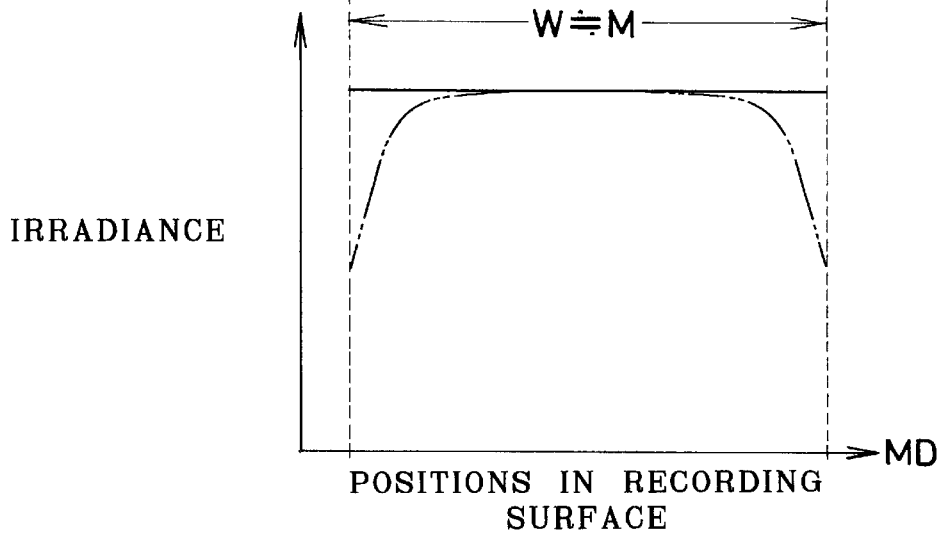
FIG. 8C is a graph illustrating a relationship similar to that of FIG. 5B but according to the structure of FIG. 8A.

In the above embodiments, the display panel light source is used at the size covering the size of the recording material 3 in the main scan direction MD. Also, another preferred embodiment of FIG. 8A is constituted by a yellow-fixing light-emitting display cell array 32 and a magenta-fixing light-emitting display cell array 33, each of which includes a number of light-emitting display cells or panels 31 as surface light source elements in the main scan direction MD. In FIG. 8B, there does not occur a drop in the emission intensity in end portions of the yellow-fixing and magenta-fixing display cell arrays 32 and 33, as indicated by the phantom lines. However irradiance of ultraviolet rays to the recording material 3 is such that irradiance in lateral edges of the recording material 3 is ½ as much as that in its middle portion, as indicated by the phantom lines in FIG. 8C. This is because a ray emitting area of the yellow-fixing and magenta-fixing display cell arrays 32 and 33 opposed to the lateral edges of the recording material 3 is ½ as large as that in its middle portion.

To solve the problem in the shortage in irradiance at the end positions of the yellow-fixing and magenta-fixing display cell arrays 32 and 33 in the main scan direction MD, they are electrically controlled in the manner of FIG. 8B by use of light source drivers 60 and 62 (See FIG. 1). End light-emitting display cells 31 disposed in the end positions in the arrays 32 and 33 are caused to emit rays at higher intensity than middle light-emitting display cells 31 disposed in the middle position in the arrays 32 and 33. Thus the shortage in rays applied to the lateral edge portions of the recording material 3 in the main scan direction MD is compensated for. As indicated by the solid line in FIG. 8C, application of the ultraviolet rays can be uniformly regularized in the entirety of the recording material 3.

Note that the cyan coloring layer does not have fixability in response to ultraviolet rays. In the magenta fixation, it is possible not to control the emission intensity electrically but to drive the magenta-fixing display cell array 33 fully. Furthermore, the yellow-fixing and magenta-fixing display cell arrays 32 and 33 may be driven fully also in the bleaching during ejection of the recording material 3 after thermal recording.

Figure 9A:
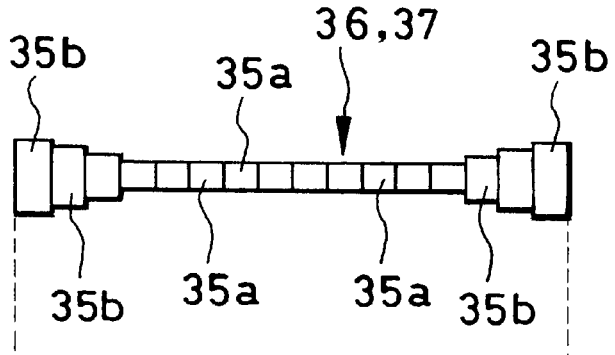
FIG. 9A is a bottom plan illustrating an array of light-emitting display panels of which end panels have a larger size.
Figure 9B:
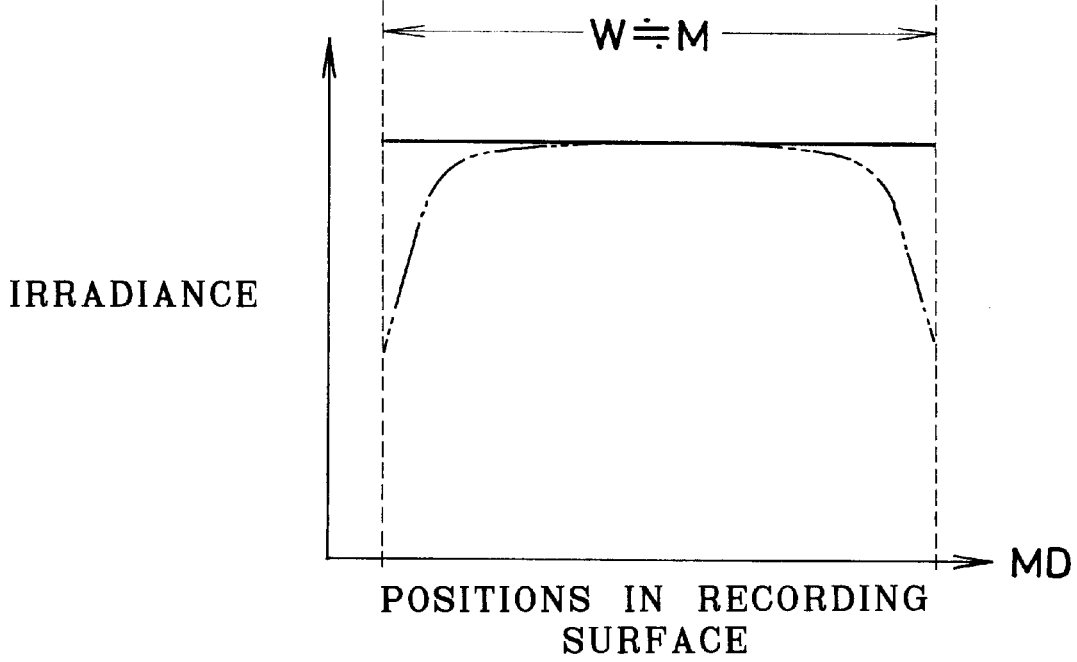
FIG. 9B is a graph illustrating a relationship similar to that of FIG. 5B but according to the structure of FIG. 9A.

In FIG. 9A, a further preferred embodiment is illustrated, in which end light-emitting display cells or panels 35*b* have a greater size in the sub scan direction than middle light-emitting display cells or panels 35*a* in each of a yellow-fixing light-emitting display cell array 36 and a magenta-fixing light-emitting display cell array 37. The shortage in rays applied to the lateral edge portions of the recording material 3 in the main scan direction MD is compensated for. As illustrated in FIG. 9B, application of the ultraviolet rays can be uniformly regularized in the entirety of the recording material 3.

Figure 10A:
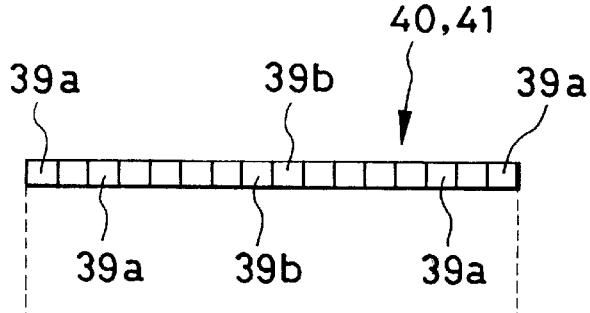
FIG. 10A is a bottom plan illustrating an array of light-emitting display panels in which a thickness of fluorescent film is changed.
Figure 10B:
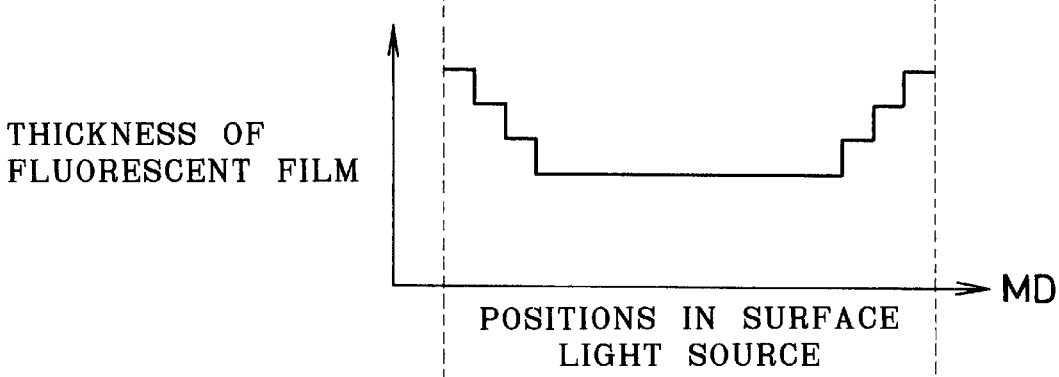
FIG. 10B is a graph illustrating a relationship similar to that of FIG. 7B but according to the structure of FIG. 10A.
Figure 10C:
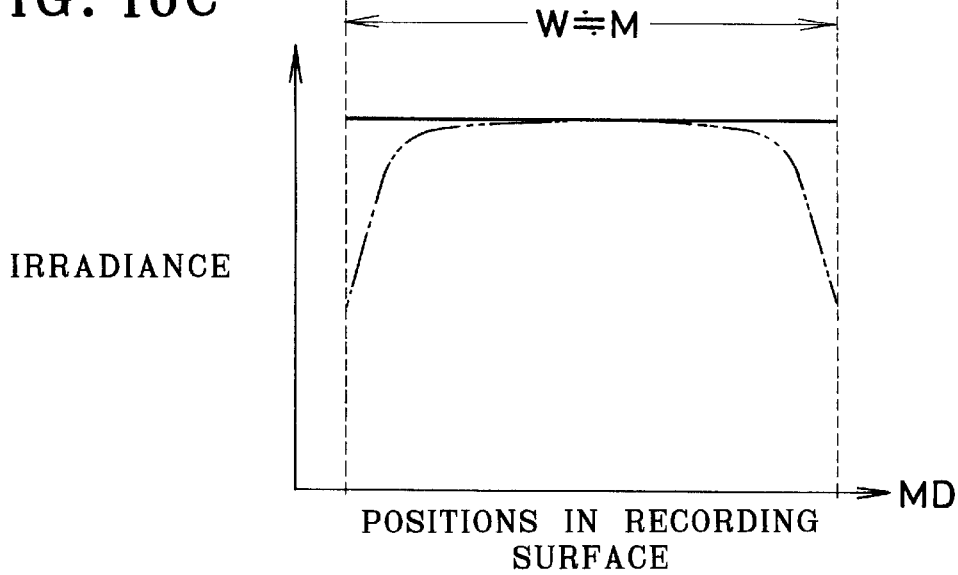
FIG. 10C is a graph illustrating a relationship similar to that of FIG. 5B but according to the structure of FIG. 10A.

In FIGS. 10A and 10B, another preferred embodiment is depicted. A yellow-fixing light-emitting display cell array 40 and a magenta-fixing light-emitting display cell array 41 may be constructed with end light-emitting display cells or panels 39*a* in which a panel base plate is coated with a fluorescent film at a greater thickness than that included in middle light-emitting display cells or panels 39*b*. Again it is possible to apply ultraviolet rays to the recording material 3 at a uniform irradiance to fix the yellow and magenta coloring layers without unevenness. See FIG. 10C.

It is to be noted that yellow-fixing and magenta-fixing light-emitting display cell arrays can have a length equal to that of the embodiment of FIG. 5A, or greater than the size W of the recording material 3 in the main scan direction MD by the amount 2L. End portions of the arrays are prevented from being opposed to the recording material 3.

In the embodiments of FIGS. 8A–10C, each of the light-emitting display cell arrays 32, 33, 36, 37, 40, 41 has a great number of display cells. However each of the display cell arrays may have at least three display cells.

Figure 11A:
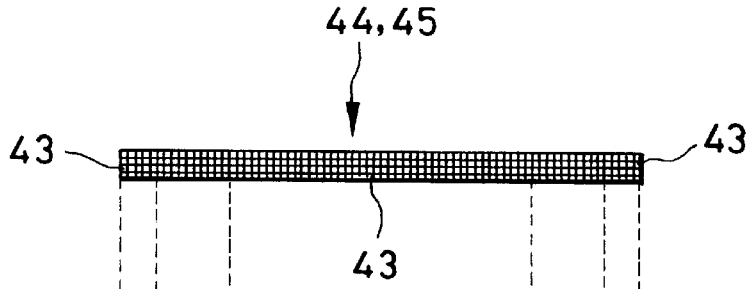
FIG. 11A is a bottom plan illustrating a group of light-emitting display panels arranged in a matrix.

In FIG. 11A, an additional preferred embodiment is illustrated. A fixer includes light-emitting display cells or panels 43 as surface light source elements, which are arranged in plural lines extending in the main scan direction MD and in plural columns extending in the sub scan direction SD, and constitute a yellow-fixing light-emitting display cell group 44 and a magenta-fixing light-emitting display cell group 45. However irradiance in lateral edges of the recording material 3 is ½ as much as that in its middle portion, as indicated by the phantom lines in FIG. 1C. This is because a ray emitting area of the yellow-fixing and magenta-fixing display cell groups 44 and 45 opposed to the lateral edges of the recording material 3 is ½ as large as that in its middle portion.

Figure 11B:
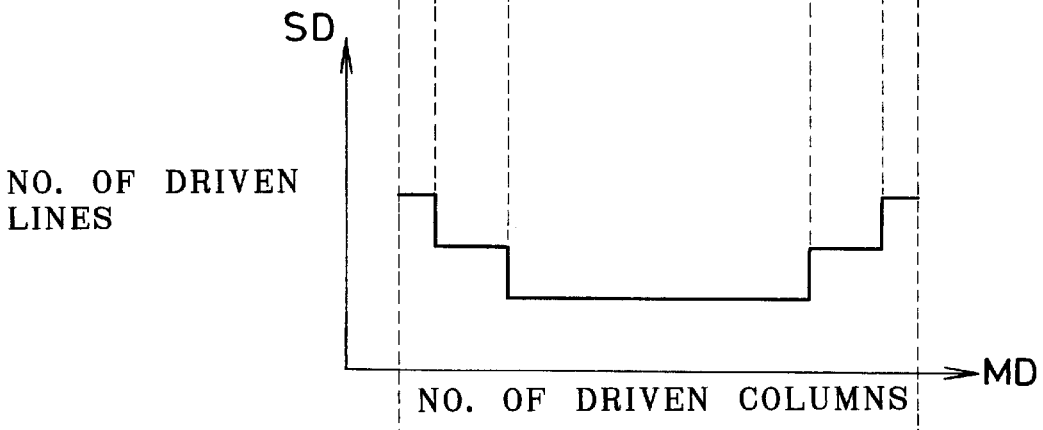
FIG. 11B is a graph illustrating a relationship between the number of driven columns and the number of driven lines.
Figure 11C:
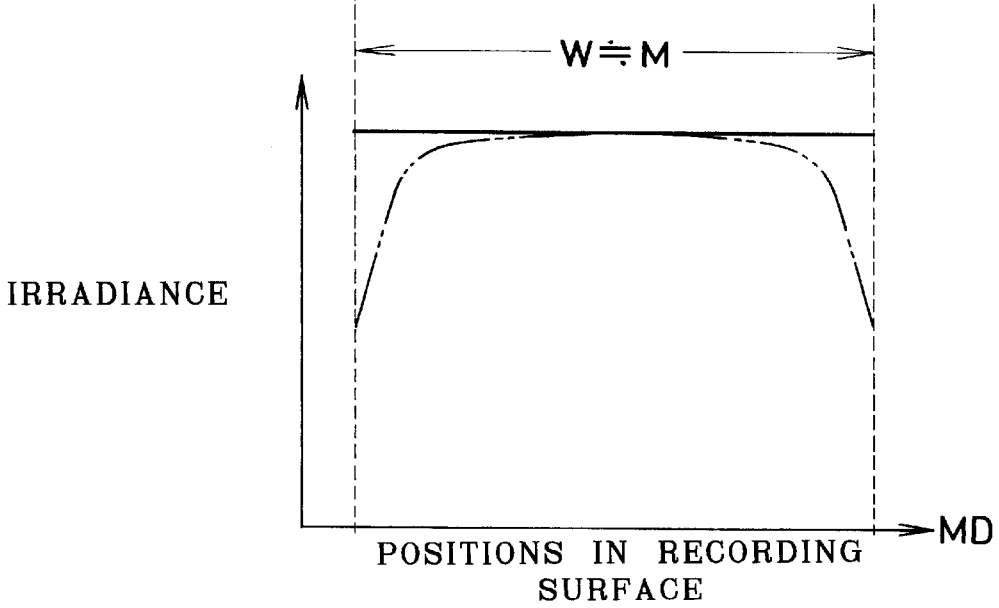
FIG. 11C is a graph illustrating a relationship similar to that of FIG. 5B but according to the structure of FIG. 11A.

In FIG. 11B, the number of energized columns of the display cells 43 at the end positions with reference to the main scan direction MD is determined greater than the number of energized columns of the display cells 43 at the middle position in the yellow-fixing and magenta-fixing display cell groups 44 and 45. A result is illustrated in FIG. 1C, in which the recording material 3 can be supplied with ultraviolet rays uniformly.

In the present embodiment, it is possible to drive all the display cells in the magenta-fixing display cell group 45 in the course of magenta fixation. Furthermore, all the display cells in the yellow-fixing and magenta-fixing display cell groups 44 and 45 may be driven also in the bleaching during ejection of the recording material 3 after thermal recording.

Figure 12A:
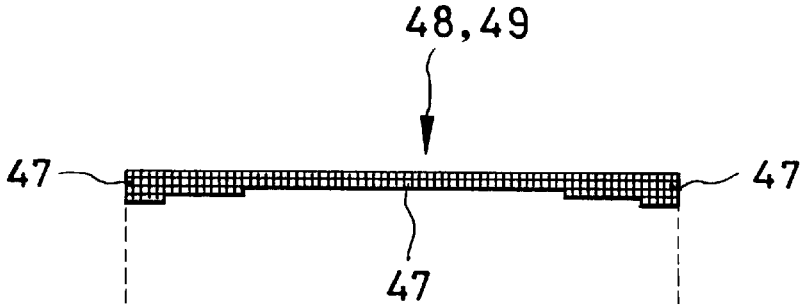
FIG. 12A a bottom plan illustrating a group of light-emitting display panels so arranged that end panels are in longer columns than middle panels.
Figure 12B:
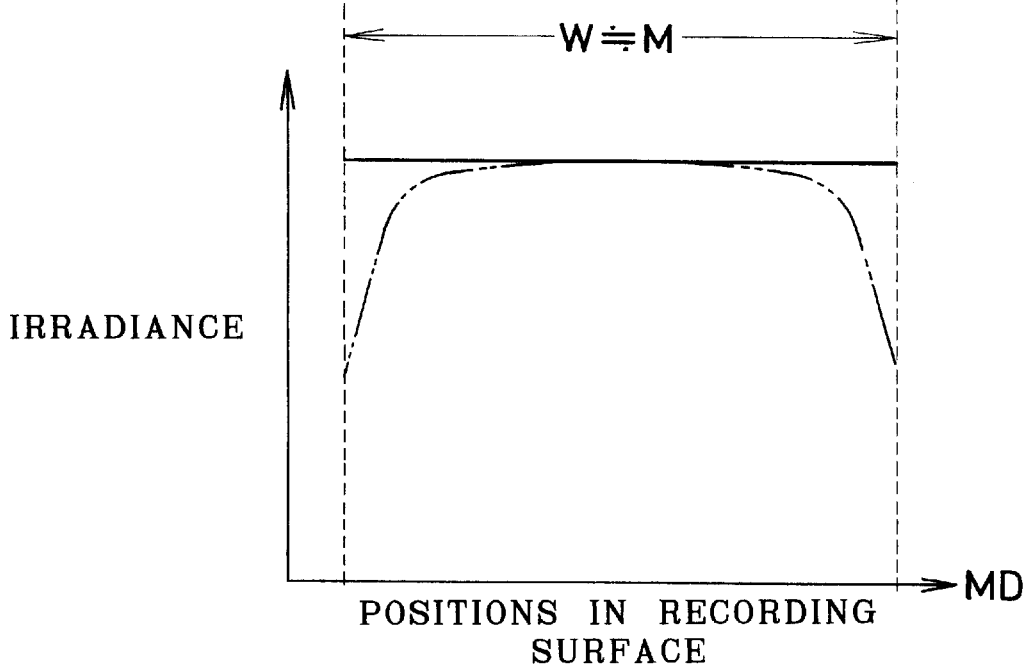
FIG. 12B is a graph illustrating a relationship similar to that of FIG. 5B but according to the structure of FIG. 12A.

In FIGS. 12A and 12B, another preferred embodiment is illustrated. The number of columns of light-emitting display cells or panels 47 at the end positions with reference to the main scan direction MD is determined greater than the number of columns of the display cells 47 at the middle position, both in a yellow-fixing light-emitting display cell group 48 and in a magenta-fixing light-emitting display cell group 49.

Also, the display cell group may have a length in the main scan direction MD greater than the width of the recording material 3 in the same direction, so as to keep the ultraviolet irradiance uniform by adjusting the ray applying distribution of the display cell group. Furthermore, each of the display cells may be electrically controlled in an individual manner. The thickness of the fluorescent film may be changed for determining the ray applying distribution.

In any of the above embodiments, the filters 15*a* and 16*a* are secured to respectively the front surfaces of the panels, cell arrays or cell groups for shifting the emission center wavelengths. However it is possible to use specialized types of fluorescent films for the purpose of shifting the emission center wavelengths.

Note that, in the embodiments of FIGS. 11A–12B, the middle light-emitting display cells in each of the display cell groups 44, 45, 48, 49 are arranged in plural lines. However each display cell group may have at least one line of middle light-emitting display cells.

In the embodiments of FIGS. 11A–12B, each of the light-emitting display cell groups 44, 45, 48, 49 has a great number of columns of display cells. However each of the display cell groups may have at least three columns of display cells.

Figure 13:
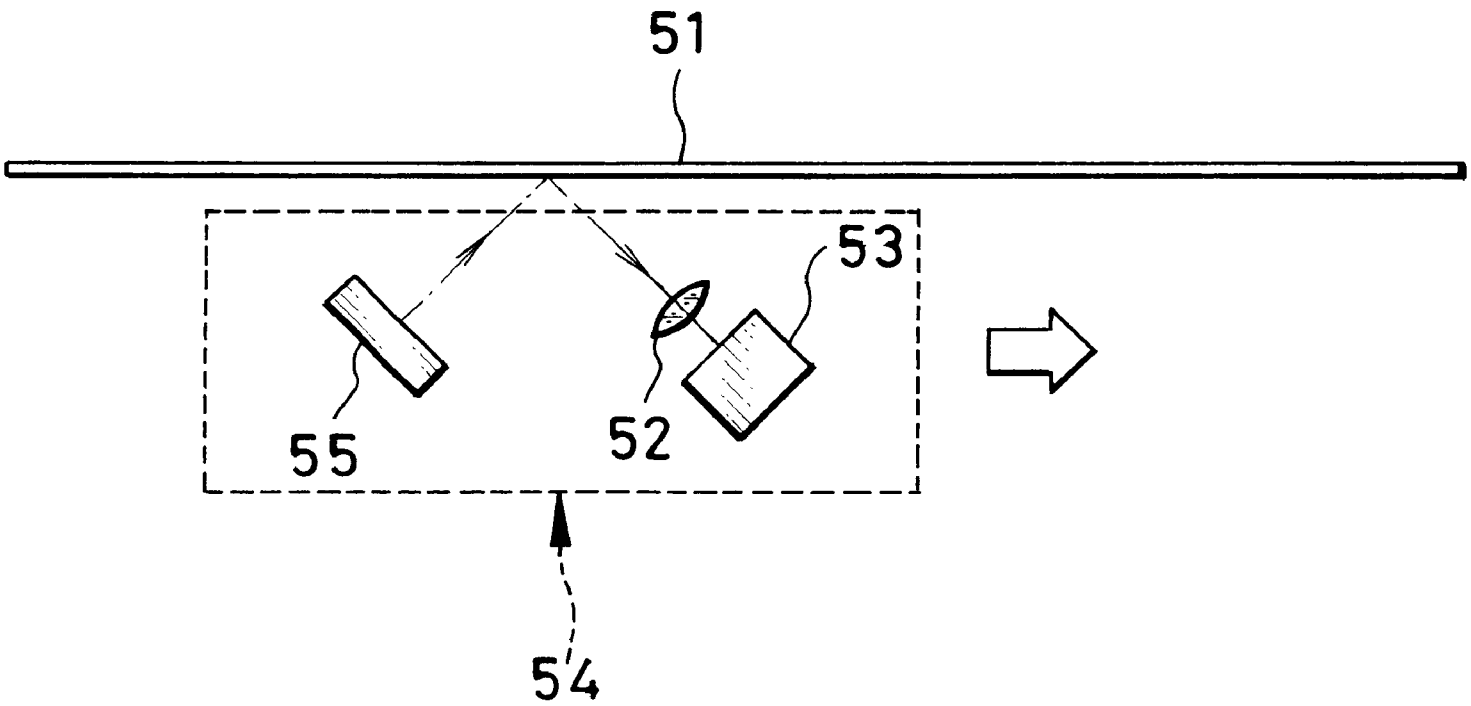
FIG. 13 is an explanatory view illustrating an image reader apparatus having a light-emitting display panel of the present invention.

In the above embodiments, the ray applying device is the optical fixer for fixing the color thermosensitive coloring material. However a ray applying device may be an illuminating device 55. See FIG. 13. The illuminating device 55 is incorporated in an image reader apparatus 54, which includes a focusing lens 52 and an image sensor 53. An original sheet 51 as target object is placed and opposed to the focusing lens 52. The image reader apparatus 54 is moved relatively to the original sheet 51, while the illuminating device 55 illuminates the original sheet 51. In accordance with the present invention, precision and quality in image reading of the image reader apparatus 54 can be obtained high. Also, a ray applying device or illuminating device may be incorporated in a copying machine or telefacsimile machine.

Furthermore, a ray applying device or illuminating device may be a separate device, and can be manually moved in the sub scan direction SD by a user. Or a target object may be moved relative to such a device positioned in a stationary manner.

In addition, end portions of each embodiment of the surface light source may provide rays at intensity equal to that of the middle portion without a difference. This is typically effective if object images to be printed and fixed are expected to have a small size and to be located in the center of the frame. Lateral margin portions are likely to be enlarged by shortage of fixation, but will not cause a serious problem due to the arrangement of the object image.

In the above embodiment, the light-emitting display panels and cells are arranged along the thermal head. But the light-emitting display panels and cells may be assembled with or incorporated in the thermal head, because the light-emitting display panels and cells have a small thickness and require relatively a small space. In the above embodiments, the plasma display panels are used as surface light sources in the fixer. Alternatively it is possible to use other types of light-emitting display panels, such as a light-emitting diode display panel, a field emission display panel, an inorganic electroluminescence display panel and an organic electroluminescence display panel. Furthermore, an array of plural light-emitting diodes may be used as surface light source in the fixer.

In the above embodiments, the same structure is used for the yellow-fixing surface light source and the magenta-fixing surface light source. However the structure of the present invention may be used only for the yellow-fixing surface light source, because the magenta fixation does not require minutely determined adjustment of ray applying distribution.

In the above embodiments, the size M of the light-emitting display panel, cell array or cell group in the main scan direction is determined in consideration of the size W of the recording material 3. However the size M of the light-emitting display panel, cell array or cell group in the main scan direction can be determined in consideration of a size of a recording region defined in the recording material 3 between lateral margin portions.

In the embodiments of FIGS. 4A, 4B and 6A–12B, the light-emitting display panel, cell array or cell group has the size M substantially equal to the size W of the recording material 3 in the main scan direction. But a light-emitting display panel, cell array or cell group may have a size M slightly greater than a size of the recording region of the recording material 3 in the main scan direction. This is effective typically in fixing the lateral edge portions of the recording material 3 reliably even when the recording material 3 is loosely set in the main scan direction and conveyed in a position offset from the light-emitting display panel, cell array or cell group.

Furthermore, a light-emitting display panel, cell array or cell group may have a size M smaller than a size of the recording region of the recording material 3 in the main scan direction. This is typically effective if object images to be printed and fixed are expected to have a small size and to be located in the center of the frame.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A ray applying device for applying electromagnetic rays to an object surface of a target object, said object surface extending two-dimensionally in main and sub scan directions, said ray applying device comprising:

a flat surface light source, extending in said main scan direction, for emitting said electromagnetic rays;

wherein said target object moves in said sub scan direction while said surface light source emits said electromagnetic rays;

wherein said surface light source comprises at least one light-emitting display panel; and wherein said light-emitting display panel has a size substantially equal to a size of said object surface in said main scan direction;

said light-emitting display panel includes a middle portion disposed substantially in a middle in said main scan direction, and two end portions between which said middle portion is disposed, and in which emission intensity of said electromagnetic rays is preset higher than in said middle portion, so as to provide said object surface with irradiance equal to irradiance with which said electromagnetic rays from said middle portion provides said object surface.

2. A ray applying device as defined in claim 1, wherein said electromagnetic rays are visible or ultraviolet.

3. A ray applying device as defined in claim 1, further comprising a filter, disposed in front of said surface light source, for allowing passage of said electromagnetic rays in a predetermined wavelength range.

4. A ray applying device as defined in claim 1, wherein said end portions have a greater size in said sub scan direction than said middle portion, for increasing said emission intensity.

5. A ray applying device as defined in claim 1, wherein said light-emitting display panel includes:

a panel body; and a fluorescent film disposed on an inside of said panel body, wherein said end portions have said fluorescent film at a greater thickness than said middle portion, for increasing said emission intensity.

6. A ray applying device as defined in claim 1, wherein said target object is thermosensitive recording material, and said electromagnetic rays optically fix said thermosensitive recording material.

7. A ray applying device as defined in claim 1, wherein said at least one light-emitting display panel is an array of plural light-emitting cells arranged in said main scan direction.

8. A ray applying device as defined in claim 7, further comprising a light source driver for driving said plural light-emitting cells, for providing end light-emitting cells in said end portions with first energy, and for providing a middle light-emitting cell in said middle portion with second energy, said first energy being higher than said second energy, for increasing said emission intensity at said end light-emitting cells.

9. A ray applying device as defined in claim 7, wherein among said plural light-emitting cells, end light-emitting cells in said end portions have a greater size in said sub scan direction than a middle light-emitting cell in said middle portion, for increasing said emission intensity.

10. A ray applying device as defined in claim 7, wherein each of said light-emitting cells includes a fluorescent film, and among said plural light-emitting cells, end light-emitting cells in said end portions have said fluorescent film at a greater thickness than a middle light-emitting cell in said middle portion, for increasing said emission intensity.

11. A ray applying device as defined in claim 1, wherein said surface light source includes plural light-emitting cell arrays arranged in said sub scan direction, each of said light-emitting cell arrays includes plural light-emitting cells arranged in said main scan direction, and said light-emitting cells emit visible or ultraviolet rays.

12. A ray applying device as defined in claim 11, wherein among said plural light-emitting cells in each of said light-emitting cell arrays, emission intensity of said electromagnetic rays is preset higher in end light-emitting cells than in a middle light-emitting cell.

13. A ray applying device as defined in claim 12, further comprising a light source driver for providing said end light-emitting cells with first energy, and for providing said middle light-emitting cell with second energy, said first energy being higher than said second energy, for increasing said emission intensity at said end light-emitting cells.

14. A ray applying device as defined in claim 11, wherein each of said light-emitting cells includes a fluorescent film, and said end light-emitting cells have said fluorescent film at a greater thickness than said middle light-emitting cell, for increasing said emission intensity.

15. A ray applying device as defined in claim 1, wherein said surface light source includes plural light-emitting cells arranged in a matrix manner;

a number of lines of said light-emitting cells is greater at ends of said object surface than at a middle of said object surface.

16. A ray applying device as defined in claim 1, wherein the size of said object surface in said main scan direction is a maximum size for which the ray applying device applies electromagnetic rays to the object surface of the target object in said main scan direction.

17. A ray applying device for applying electromagnetic rays to an object surface of a target object, said object surface extending two-dimensionally in main and sub scan directions, said ray applying device comprising:

a flat surface light source, extending in said main scan direction, for emitting said electromagnetic rays;

wherein said target object moves in said sub scan direction while said surface light source emits said electromagnetic rays;

wherein said surface light source comprises at least one light-emitting display panel; and wherein said light-emitting display panel has a size greater than a size of said object surface in said main scan direction.

18. A ray applying device for applying electromagnetic rays to an object surface of a target object, said object surface extending two-dimensionally in main and sub scan directions, said ray applying device comprising:

an array of plural surface light source elements, arranged in said main scan direction, for emitting said electromagnetic rays;

wherein said array of plural surface light source elements has a size substantially equal to a size of said object surface in said main scan direction; and wherein emission intensity of said electromagnetic rays at end portions of said array of plural surface light source elements is higher than in a middle portion of said array of plural surface light source elements, so as to provide said object surface with uniform irradiance across an entire length of said object surface in said main scan direction.

19. A ray applying device for applying electromagnetic rays to an object surface of a target object, said object surface extending two-dimensionally in main and sub scan directions, said ray applying device comprising:

a group of plural surface light source elements, arranged in plural lines extending in said main scan direction and in plural columns extending in said sub scan direction, for emitting said electromagnetic rays;

wherein said group of plural surface light source elements has a size substantially equal to a size of said object surface in said main scan direction; and wherein emission intensity of said electromagnetic rays at end portions of said group of plural surface light source elements is higher than in a middle portion of said group of plural surface light source elements, so as to provide said object surface with uniform irradiance across an entire length of said object surface in said main scan direction.

20. A ray applying device for applying electromagnetic rays to an object surface of a target object, said object surface extending two-dimensionally in main and sub scan directions, said ray applying device comprising:

a light source for emitting said electromagnetic rays and extending in said main scan direction with end portions and a middle portion, wherein an intensity of light emitted from said end portions of said light source differs from an intensity of light emitted from said middle portion of said light source.

21. The ray applying device as defined in claim 20, wherein the intensity of light emitted from said end portions of said light source is greater than the intensity of light emitted from said middle portion of said light source.

22. The ray applying device as defined in claim 20, wherein said light source is a flat surface light source.

23. The ray applying device as defined in claim 20, wherein said target object moves in said sub scan direction while said light source emits said electromagnetic rays.

* * * * *